US008061573B2

(12) United States Patent
Kramer

(10) Patent No.: US 8,061,573 B2
(45) Date of Patent: Nov. 22, 2011

(54) MODE SWITCH FOR FASTENER DRIVING TOOL

(75) Inventor: Gregory A. Kramer, Cincinnati, OH (US)

(73) Assignees: Campbell Hausfeld, Harrison, OH (US); Scott Fetzer Company, Harrison, OH (US)

( * ) Notice: Subject to any disclaimer, the term of this patent is extended or adjusted under 35 U.S.C. 154(b) by 194 days.

(21) Appl. No.: 12/434,812

(22) Filed: May 4, 2009

(65) Prior Publication Data

US 2010/0276467 A1 Nov. 4, 2010

(51) Int. Cl.
*B27F 7/09* (2006.01)

(52) U.S. Cl. ..... 227/8; 227/130; 227/131

(58) Field of Classification Search ..... 227/8, 130, 227/142, 156, 131; 200/332.2
See application file for complete search history.

(56) References Cited

U.S. PATENT DOCUMENTS 6,543,664 B2 * 4/2003 Wolfberg ..... 227/8
6,643,439 B2 * 11/2003 Notomi et al. ..... 385/125
6,929,165 B1 * 8/2005 Chen et al. ..... 227/8
7,152,773 B2 * 12/2006 Ke ..... 227/8
7,197,961 B2 4/2007 Kageler et al.
7,431,103 B2 10/2008 Schell et al.
7,476,821 B1 1/2009 Knuppel
2003/0121947 A1 * 7/2003 Hsu ..... 227/8
2005/0067453 A1 * 3/2005 Huang ..... 227/8
2005/0184120 A1 8/2005 Terrell et al.
2006/0219749 A1 * 10/2006 Huang ..... 227/8
2006/0249554 A1 * 11/2006 Butzen et al. ..... 227/130
2007/0108249 A1 5/2007 Moeller

* cited by examiner

*Primary Examiner* — Rinaldi Rada
*Assistant Examiner* — Nathaniel Chukwurah
(74) *Attorney, Agent, or Firm* — Jones Day

(57) ABSTRACT

An fastener driving apparatus has an actuator linked to a work contact element so as to move a trigger plate when the work contact element retracts. A button is movable back and forth along a transverse axis when depressed from its opposite ends. The actuator has a bump mode surface and a sequential mode surface at different locations along the axis, and is moveable transversely back and forth between a bump mode arrangement in which the bump mode surface can move the trigger plate and a sequential mode arrangement in which the sequential mode surface can move the trigger plate. The button is linked to the actuator so as to move the actuator to the bump mode arrangement when depressed from one end, and to move the actuator to the sequential mode arrangement when depressed from the opposite end.

19 Claims, 8 Drawing Sheets

MODE SWITCH FOR FASTENER DRIVING TOOL

TECHNICAL FIELD

This technology relates to a fastener driving tool, such as a nailer.

BACKGROUND

A fastener driving tool may be capable of switching back and forth between a bump mode of operation and a sequential mode of operation. In the sequential mode, the tool will not drive a fastener unless the user first presses the tool against a workpiece and then pulls the trigger while holding the tool in place.

The bump mode allows the user to pull the trigger either before or after pressing the tool against the workpiece. Therefore, if the user first presses and holds the tool against the workpiece in the bump mode, the tool will eject a fastener when the user next pulls the trigger. On the other hand, if the user first pulls the trigger in the bump mode, the tool will drive a fastener when the user next presses the tool against the workpiece while holding the trigger back. As long as the user holds the trigger back in the bump mode, the tool will again drive a fastener each time the user presses or "bumps" the tool against the workpiece.

SUMMARY OF THE INVENTION

A fastener driving apparatus includes a nose that ejects a fastener in a forward direction. The apparatus has a housing with a front end from which the nose projects in the forward direction, and has a work contact element that retracts relative to the nose. An actuator is linked to the work contact element so as to move a trigger plate upon retraction of the work contact element. A button has opposite ends at opposite sides of the housing, and is movable back and forth in the housing in sideways directions perpendicular to the forward direction when depressed from its opposite ends. The button is linked to the actuator so as to move the actuator to a bump mode arrangement when depressed from one end, and to move the actuator to a sequential mode arrangement when depressed from the opposite end.

In a preferred embodiment, the actuator has a bump mode surface and a sequential mode surface at different locations along a transverse axis perpendicular to the forward direction. The button moves the actuator transversely back and forth for either the bump mode surface or the sequential mode surface to move the trigger plate upon retraction of the work contact element.

DETAILED DESCRIPTION

Figure 1:
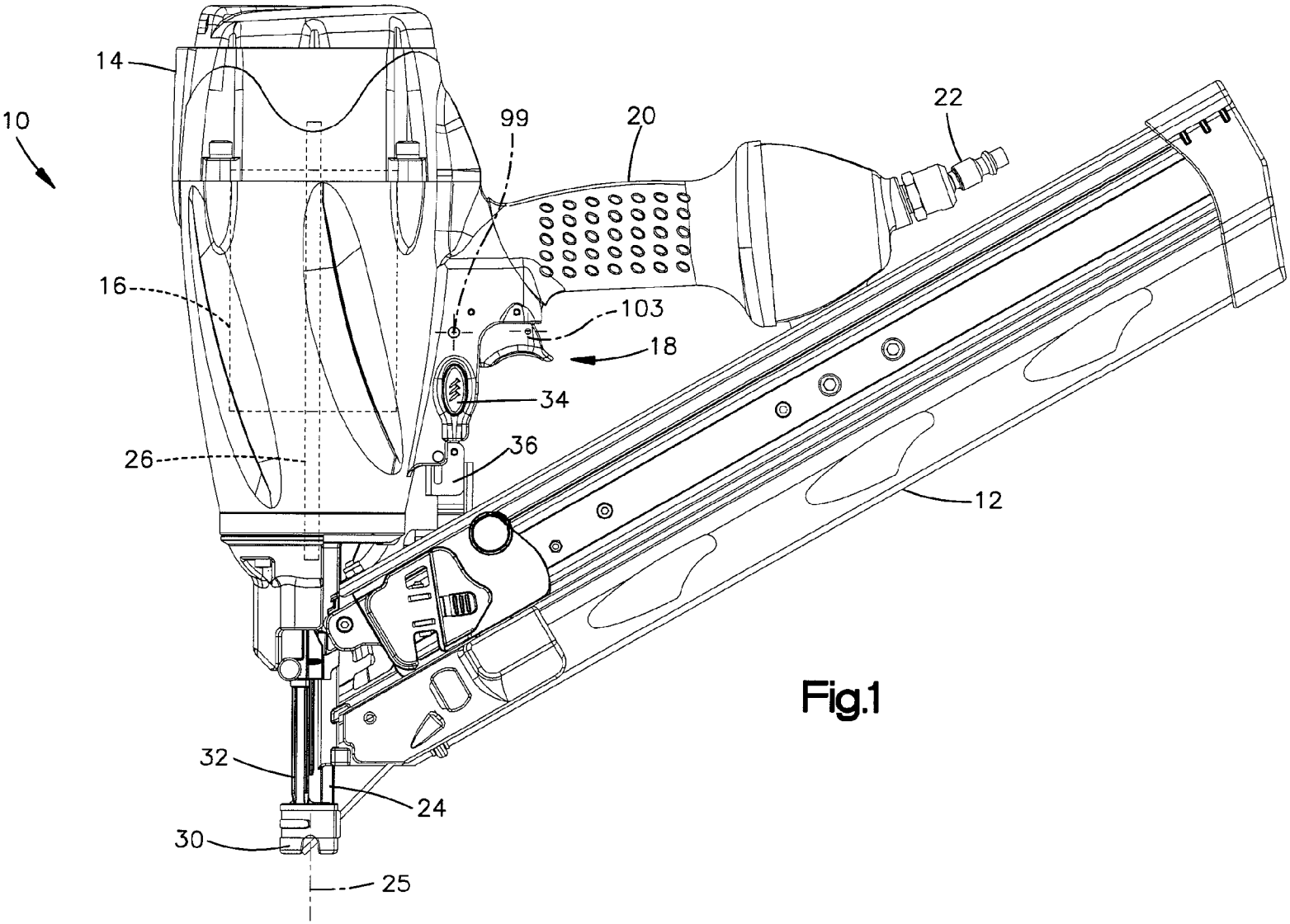
FIG. 1 shows a tool equipped with the claimed invention.

The structures shown schematically in the drawings have parts that are examples of the elements recited in the claims. The illustrated structures thus include examples of how a person of ordinary skill in the art can make and use the claimed invention. They are described here to meet the enablement and best mode requirements of the patent statute without imposing limitations that are not recited in the claims.

The tool 10 shown in FIG. 1 is an example of a fastener driving device equipped with the claimed invention. This particular tool 10 is a nailer with a nail magazine 12. The nailer 10 has a housing 14 containing a pneumatic motor 16, and has a trigger assembly 18 for actuating the motor 16. A handle portion 20 of the housing 14 has a fitting 22 for connection with a pneumatic line to power the motor 16. A nose 24 projects forward from the housing 14 along an axis 25. The nose 24 is configured as a barrel through which a driving ram 26 is advanced by the motor 16 to drive a nail outward along the axis 25.

An optional no-mar tip 30 is located at the end of the nose 24. The tip 30 is mounted on a work contact element (WCE) 32, and is formed of a relatively soft material to protect a workpiece from being marred by contact with the WCE 32. When a user presses the tip 30 against a workpiece, the WCE 32 retracts alongside the nose 24. The trigger assembly 18 responds in either a bump mode, a sequential mode, or a lockout mode. A pushbutton 34 enables the user to switch the nailer 10 between the bump mode, the sequential mode, and the lockout mode.

Figure 2:
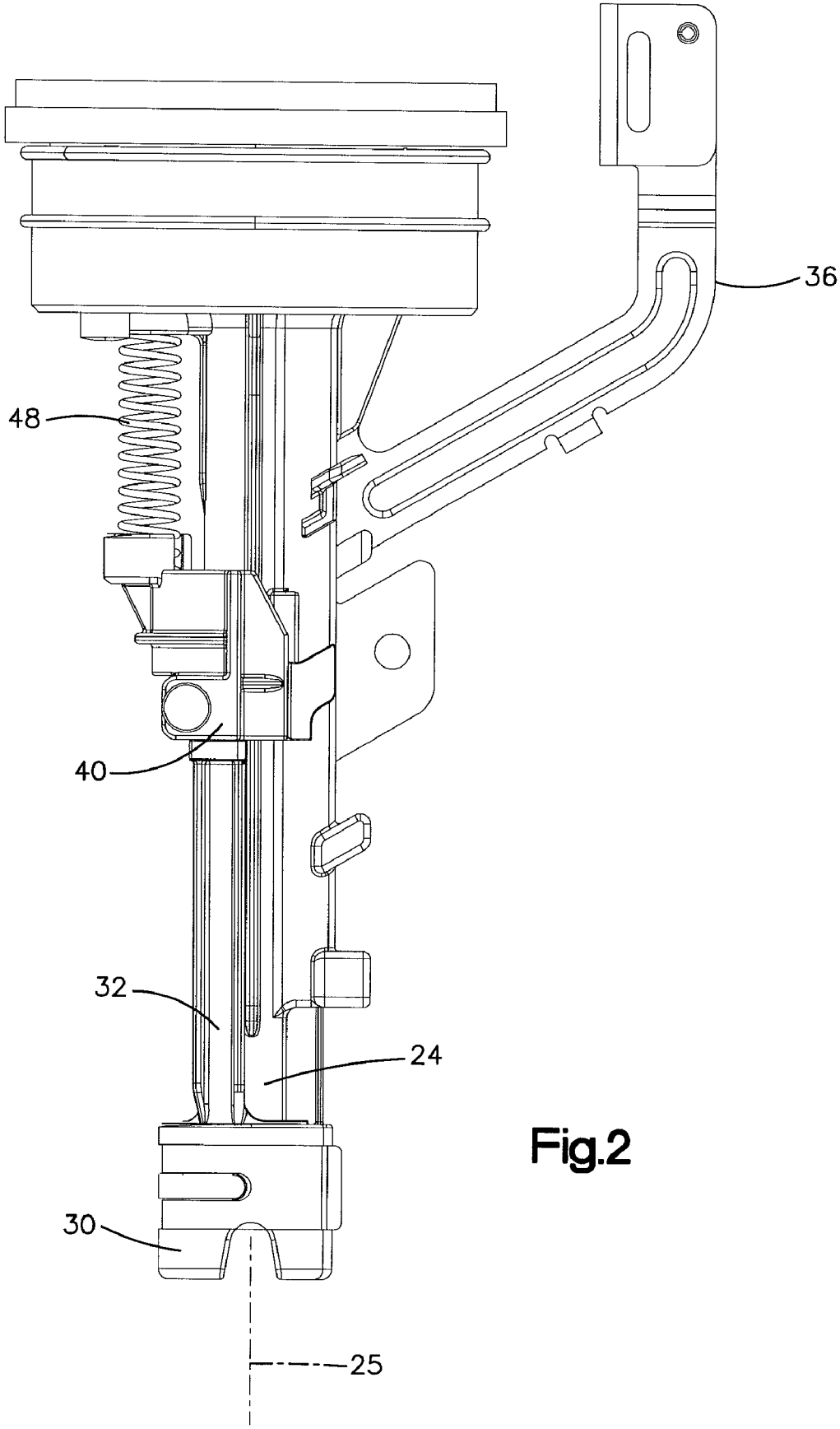
FIG. 2 shows parts of the tool.

As shown in FIG. 2, the WCE 32 is one of a pair of WCE's 32 and 36. These may be referred to as the upper WCE 36 and the lower WCE 32. In this particular example of a nailer 10, the upper and lower WCE's 36 and 32 are mutually fixed to an optional depth control assembly 40. The depth control assembly 40 operates in a known manner to adjust the depth to which the driving ram 26 will drive a nail from the nose 24 into a workpiece.

The depth control assembly 40 is mounted to slide along the nose 24. It can thus retract along the driving axis 25 against the bias of a spring 48. As the lower WCE 32 retracts when pressed against a workpiece, both the depth control assembly 40 and the upper WCE 36 retract equally relative to the trigger assembly 18 (FIG. 1). When the nailer 10 is lifted from the workpiece, the spring 48 advances those parts 40 and 36 axially forward to their original positions.

Figure 3:
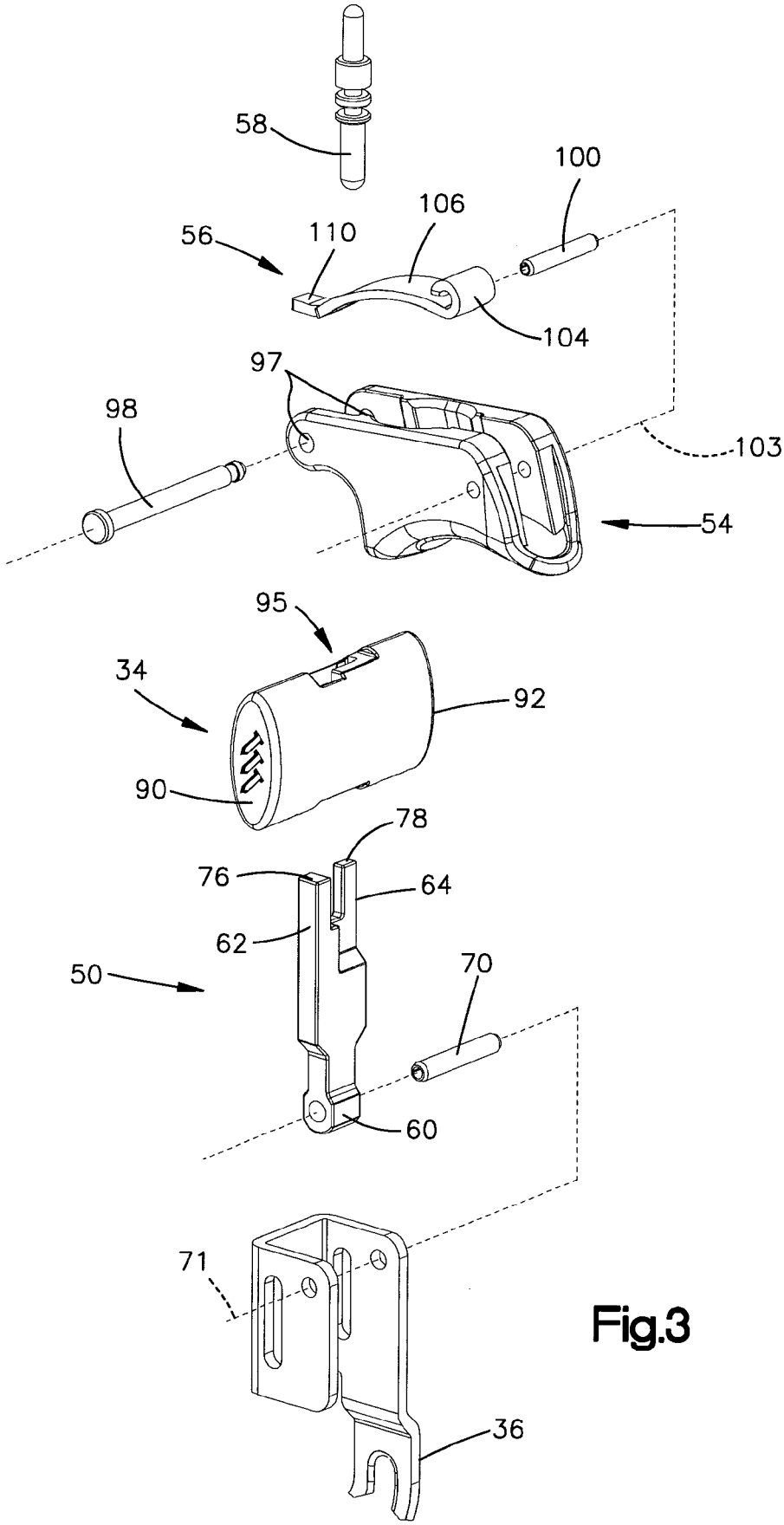
FIG. 3 is a perspective view showing other parts of the tool.

As shown in FIG. 3, the trigger assembly 18 includes an actuator 50, the pushbutton 34, and a trigger 54 with a trigger plate 56. These parts are interconnected between the upper WCE 36 and a valve stem 58. The valve stem 58 is a known device that cycles the pneumatic motor 16 when depressed by the trigger assembly 18.

As shown separately in FIGS. 4-7, the actuator 50 is a generally fork-shaped part with a base 60 at one end and a pair of arms 62 and 64 at the other end. The base 60 has a first side 66 and a second side 68. A shaft 70 projects from the opposite sides 66 and 68 of the base 60. The shaft 70 supports the actuator 50 on the upper WCE 36 for sliding movement along a transverse axis 71 that is perpendicular to the driving axis 25 at the nose 24.

Figure 7:
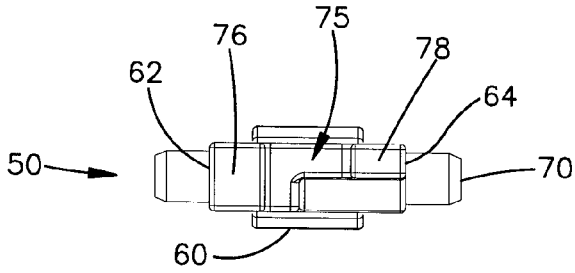
FIG. 7 is a view taken on line 7-7 of FIG. 4.
Figure 5:
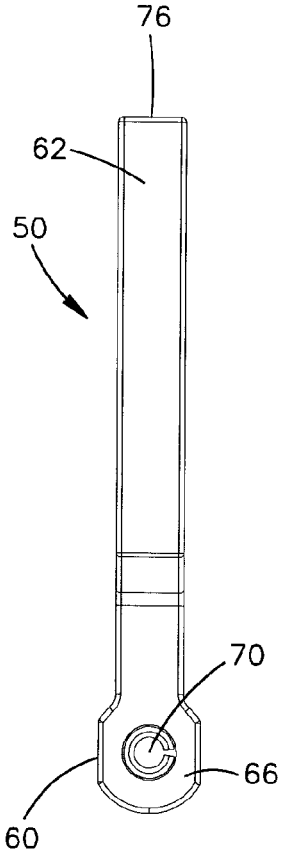
FIG. 5 is a view taken on line 5-5 of FIG. 4.
Figure 4:
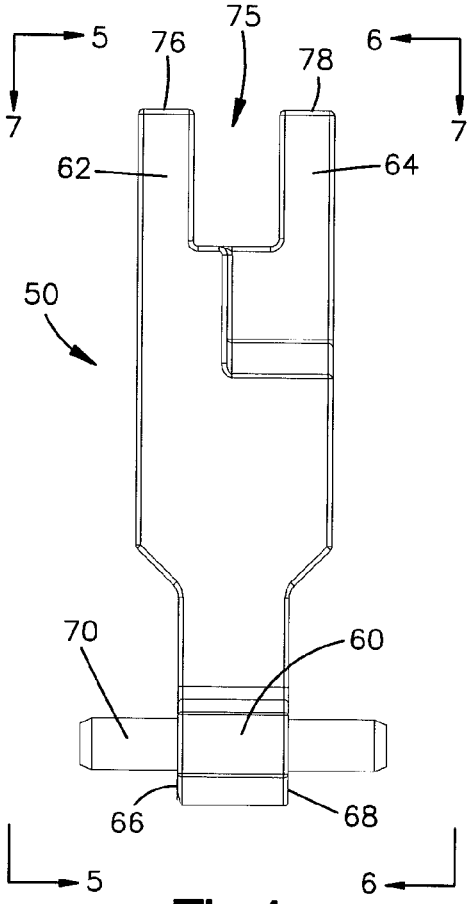
FIG. 4 shows one of the parts shown in FIG. 3.
Figure 6:
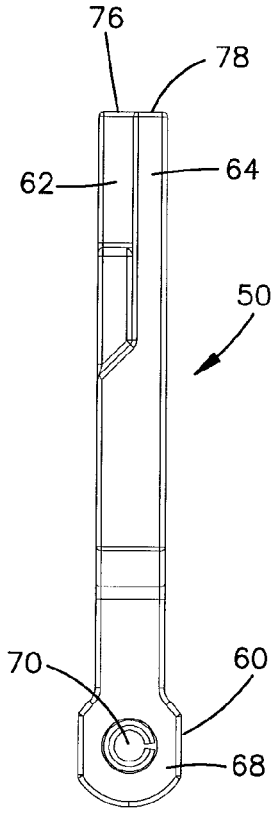
FIG. 6 is a view taken on line 6-6 of FIG. 4.

The arms 62 and 64 of the actuator 50 are transversely spaced apart from each other across a gap 75. The first arm 62 has a first free end surface 76. The second arm 64 has a second free end surface 78. As shown in FIG. 4, the free end surfaces 76 and 78 are coplanar. As shown in FIG. 7, the first free end surface 76 is larger than the second free end surface 78.

Figure 9:
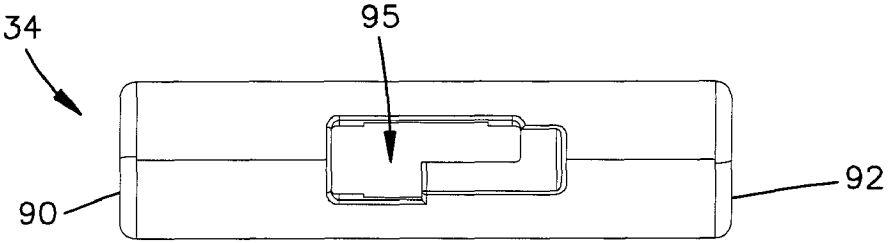
FIG. 9 is a view taken on line 9-9 of FIG. 8.
Figure 8:
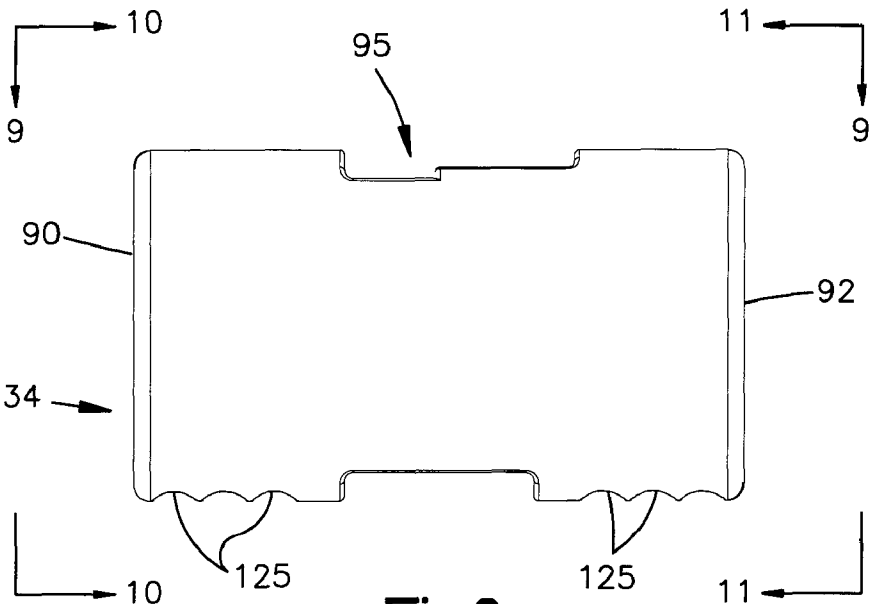
FIG. 8 shows another of the parts shown in FIG. 3.
Figure 11:
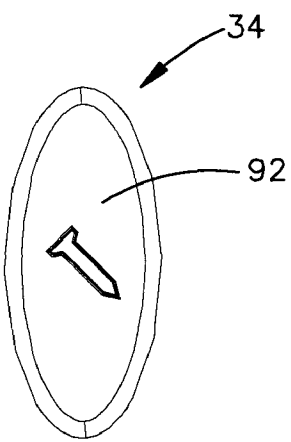
FIG. 11 is a view taken on line 11-11 of FIG. 8.
Figure 10:
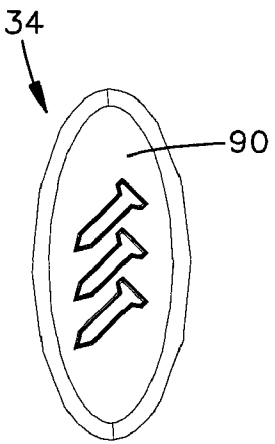
FIG. 10 is a view taken on line 10-10 of FIG. 8.
Figure 13:
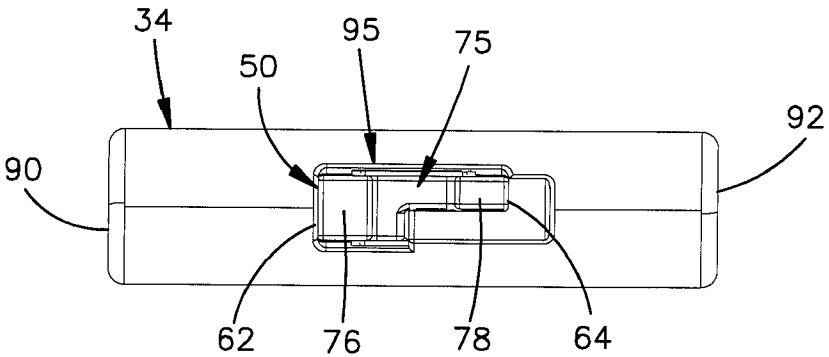
FIG. 13 is view taken on line 13-13 of FIG. 12.
Figure 12:
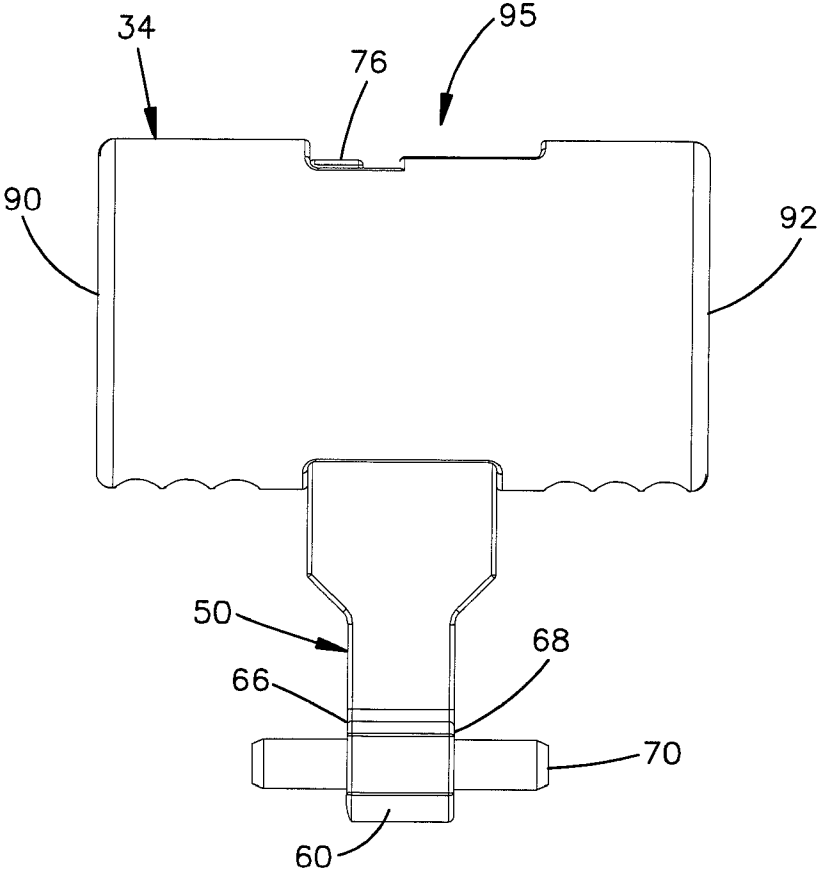
FIG. 12 shows the part of FIG. 8 fitted within the part of FIG. 4.

The pushbutton 34 is elongated in the direction of the transverse axis 71. It has an oval cross section, as shown in FIGS. 8 and 9, with a bump mode selection surface 90 at one end and a sequential mode selection surface 92 at the opposite end. The mode selection surfaces 90 and 92 preferably have corresponding indicia, as shown for example in FIGS. 10 and 11. A slot 95 extends through the pushbutton 34, and the actuator 50 extends through the slot 95, as shown in FIGS. 12 and 13. The slot 95 is shaped to block the actuator 50 from moving relative to the pushbutton 34 along the transverse axis 71, but to permit the actuator 50 to move relative to the pushbutton 34 in a direction parallel to the driving axis 25.

The trigger 54 has a pair of openings 97 at its inner end. Those openings 97 receive a pin 98 which, as shown in FIG. 1, supports the trigger 54 for movement relative to the housing 14 pivotally about a fixed axis 99. Another pin 100 at the outer end of the trigger 54 supports the trigger plate 56 to move with the trigger 54 relative to the housing 14, and also to move relative to the trigger 54 pivotally about an axis 103 on the trigger 54. Although the axis 103 on the trigger 54 moves with the trigger 54, it remains parallel to the transverse axis 71 at the upper WCE 36.

Figure 14:
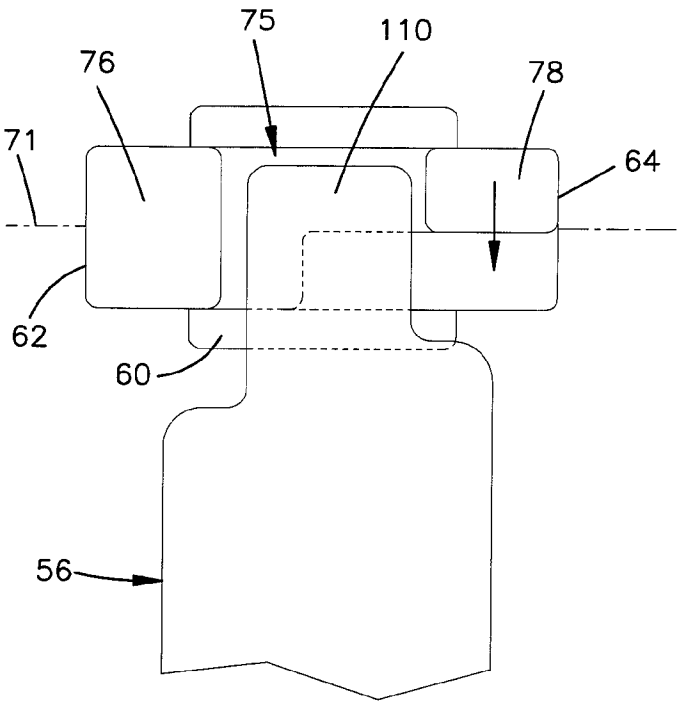
FIG. 14 is partial view of two parts shown in FIG. 3.

The trigger plate 56 has an outer end portion 104, and intermediate portion 106, and an inner end portion 110. The outer end portion 104 is hinged on the pin 100. The intermediate portion 106 has a convex contour facing the adjacent end of the valve stem 58. The inner end portion 110 is a tab that projects over the slot 95 in the pushbutton 34. The tab 110 thus projects over the actuator 50 in the slot 95. As shown in FIG. 14, the tab 110 is slightly narrower than the gap 75 between the free end surfaces 76 and 78 on the arms 62 and 64 of the actuator 50.

Figure 15:
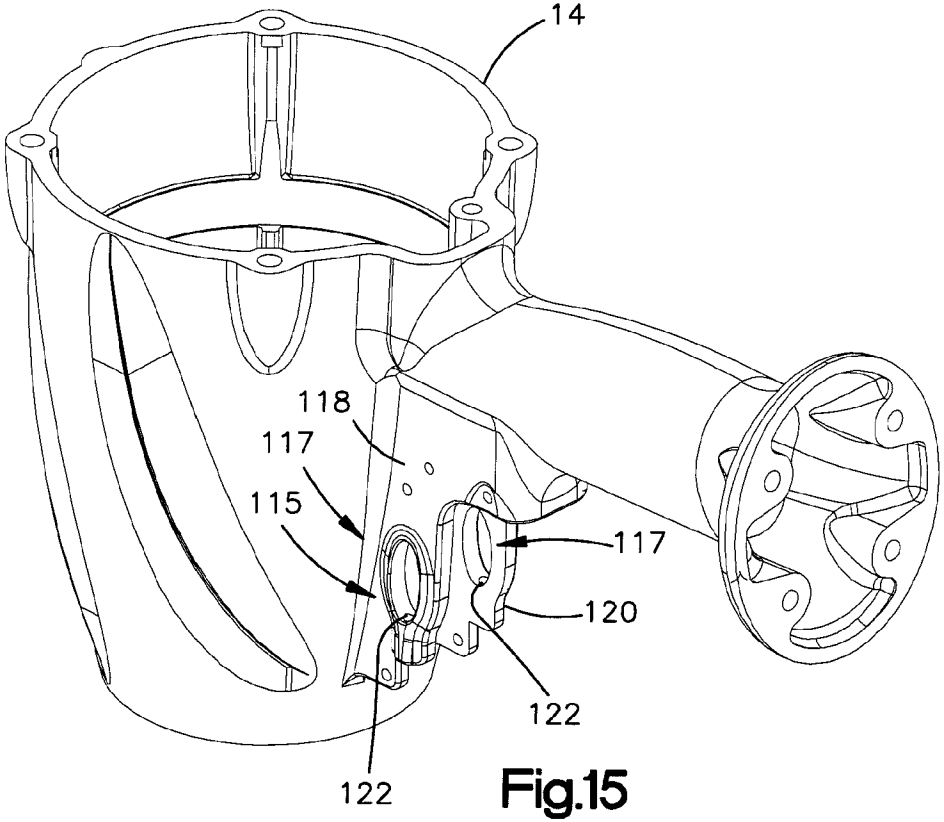
FIG. 15 is a perspective view of a part that is shown in FIG. 1.

As shown partially in FIG. 15, the housing 14 has a passage 115 defined by a pair of aligned oval openings 117 at its opposite sides 118 and 120. When the parts shown separately in FIG. 3 are interconnected in the nailer 10, as shown in FIG. 1, the pushbutton 34 extends fully through the passage 115, with the mode selection surfaces 90 and 92 facing outward of the opposite sides 118 and 120 of the housing 14. Ball detents 122 in the openings 117 (FIG. 15) engage pockets 125 (FIG. 8) in the pushbutton 34 to hold it releasably in any one of three different positions. These include a centered position in which the mode selection surfaces 90 and 92 are spaced equally outward from the opposite sides 118 and 120 of the housing 14, a bump mode position in which the bump mode selection surface 90 has been pushed inward toward the adjacent side 118 of the housing 14, and a sequential mode position in which the sequential mode selection surface 92 has been pushed inward toward the adjacent side 120 of the housing 14.

When the pushbutton 34 is pushed from the centered position to the bump mode position, it moves the actuator 50 along the transverse axis 71 in a direction from left to right as viewed in FIG. 14. This moves the first free end surface 76 into alignment with the tab 110 on the trigger plate 56. If the user then presses the tip 30 against a workpiece to retract the WCE's 32 and 36, the upper WCE 36 will move the actuator 50 rearward through the slot 95 in the pushbutton 52. The first free end surface 76 will then move against the tab 110 to lift the trigger plate 56 pivotally about the axis 103 on the trigger 54. This moves the intermediate portion 106 of the trigger plate against the valve stem 58, but not far enough to cycle the motor 16. When the user pulls the trigger 54 in that arrangement, the first free end surface 76 on the actuator 50 supports the tab 110 for further pivotal movement upward against the valve stem 58. The additional pivotal movement imparted by the trigger 54 causes the trigger plate 56 to depress the valve stem 58 sufficiently to cycle the motor 16 to drive a nail. The combined pivotal movements imparted to the trigger plate 56 by the actuator 50 and the trigger 54 can be applied in either order in the bump mode.

When the user lifts the tip 30 from the workpiece after driving a nail in the bump mode, the spring 48 moves the upper WCE 36 back from its retracted position to its original advanced position. However, if the user does not release the trigger 54 but instead holds it in the pulled position, the first free end surface 76 on the actuator 50 will again move against the tab 110 sufficiently for the trigger plate 56 to depress the valve stem 58 to cycle the motor 16, and thereby to drive another nail, each time the upper WCE 36 is again retracted by contact with the workpiece.

Figure 16B:
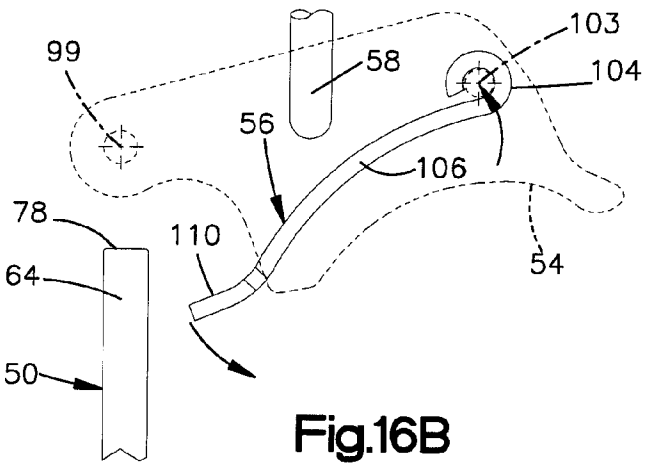
FIGS. 16A and 16B are schematic views of the parts shown in FIG. 14.
Figure 16A:
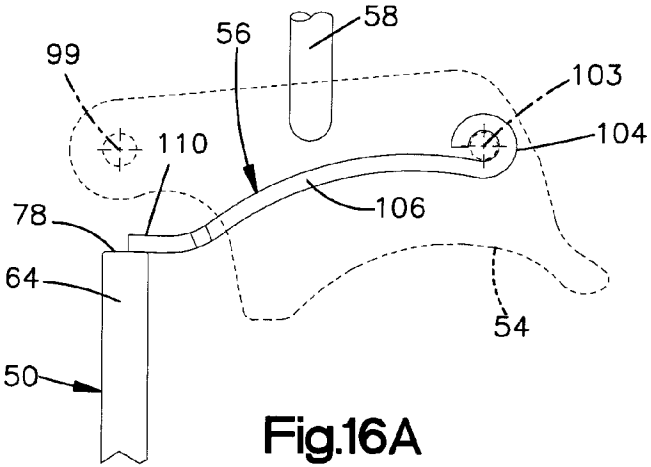
Figure 17B:
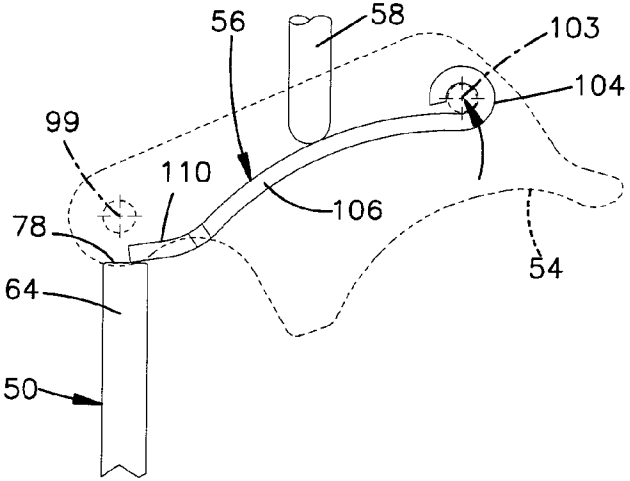
FIGS. 17A and 17B also are schematic views of the parts shown in FIG. 14.
Figure 17A:
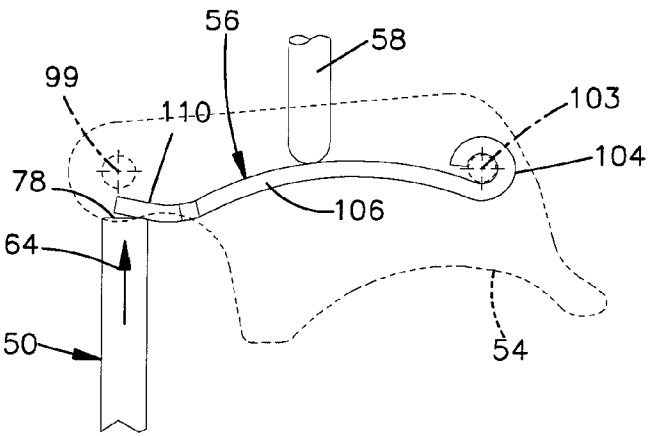

Pushing the pushbutton 34 to the sequential mode position moves the actuator 50 from right to left, as viewed in FIG. 14, to move the second free end surface 78 transversely into the alignment with the tab 110 on the trigger plate 56. The user might then pull the trigger 54 before pressing the tip 30 against a workpiece to retract the WCE's 32 and 36. If so, movement of the trigger 54 pivotally about the fixed axis 99 will then draw the trigger plate 56 partially in the direction indicated by the arrow shown in FIG. 14. The second free end surface 78 is sized for the tab 110 to slide off of that surface 78 when the trigger plate 56 moves in this manner, as shown in FIGS. 16A and 16B. As a result, the actuator 50 can not move the trigger plate 56 against the valve stem 58 to cycle the motor 16 upon retraction of the upper WCE 36 because the tab 110 has been moved out of the retracting path of movement of the second free end surface 78. The user must first press the tip 30 against the workpiece to retract the upper WCE 36. This moves the second free end surface 78 upward to a position from which the tab 110 will not drop off when the trigger 54 is pulled, as shown in FIGS. 17A and 17B. Accordingly, the trigger plate 56 will depress the valve stem 58 to drive a nail in the sequential mode only if the upper WCE 36 is retracted before the trigger 54 is pulled.

Pushing the pushbutton 34 back to the centered position of FIG. 14 aligns the tab 110 with the gap 75 between the upper end surfaces 76 and 78 of the actuator arms 62 and 64. This places the nailer 10 in a safety lockout mode in which neither of the free end surfaces can 76 and 78 can support or contribute to pivotal movement of the trigger plate 56. Since the movement imparted by the trigger 54 alone can not depress the valve stem 58 to cycle the motor 16, the user can not drive a nail by pulling the trigger 54 in the safety lockout mode.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have structural elements that do not differ from the literal language of the claims, or if they have equivalent structural elements with insubstantial differences from the literal language of the claims.

The invention claimed is:

1. A fastener driving apparatus comprising:

a nose configured to eject a fastener forward along a driving axis;

a work contact element configured to retract relative to the nose;

a trigger;

a trigger plate mounted on the trigger to move relative to the trigger; and an actuator that a) is linked to the work contact element so as to move the trigger plate upon retraction of the work contact element, b) has a bump mode surface and a sequential mode surface at different locations along a transverse axis perpendicular to the driving axis, and c) is moveable relative to the trigger plate transversely back and forth between a bump mode arrangement in which the bump mode surface can move the trigger plate and a sequential mode arrangement in which the sequential mode surface can move the trigger plate.

2. A fastener driving apparatus as defined in claim 1 wherein the actuator is mounted on the work contact element so as to slide transversely across the work contact element between the bump mode arrangement and the sequential mode arrangement.

3. A fastener driving apparatus as defined in claim 1 wherein the bump mode surface and the sequential mode surface are coplanar.

4. A fastener driving apparatus as defined in claim 1 wherein the bump mode surface is larger than the sequential mode surface.

5. A fastener driving apparatus as defined in claim 1 wherein the bump mode surface and the sequential mode surface are transversely spaced apart from each other across a gap in the actuator.

6. A fastener driving apparatus as defined in claim 1 wherein actuator is configured with a safety mode feature located between the bump mode surface and the sequential mode surface, and is moveable relative to the trigger plate transversely into and out of a safety mode arrangement in which the safety mode feature prevents the actuator from moving the trigger plate upon retraction of the work contact element.

7. A fastener driving apparatus as defined in claim 1 wherein the safety mode feature comprises a gap into which the trigger plate is receivable upon retraction of the work contact element.

8. A fastener driving apparatus as defined in claim 7 wherein the bump mode surface and the sequential mode surface are transversely spaced apart from each other across the gap.

9. A fastener driving apparatus as defined in claim 1 wherein the trigger plate is movable with the trigger to a pulled position, the actuator is moveable with the work contact element to a retracted position, and the actuator is configured to move to the retracted position in the sequential mode arrangement without contacting the trigger plate if the trigger plate is in the pulled position.

10. A fastener driving apparatus comprising:

a nose configured to eject a fastener forward along a driving axis;

a work contact element configured to retract relative to the nose;

a trigger;

a trigger plate mounted on the trigger to move relative to the trigger;

an actuator that a) is linked to the work contact element so as to move the trigger plate upon retraction of the work contact element, b) has a bump mode surface and a sequential mode surface at different locations along a transverse axis perpendicular to the driving axis, and c) is moveable relative to the trigger plate transversely back and forth between a bump mode arrangement in which the bump mode surface can move the trigger plate and a sequential mode arrangement in which the sequential mode surface can move the trigger plate; and a button that has opposite ends and is linked to the actuator so as to move the actuator transversely to the bump mode position when depressed from one end and to move the actuator transversely to the sequential mode position when depressed from the opposite end.

11. A fastener driving apparatus as defined in claim 10 wherein the actuator is further movable relative to the trigger plate to a safety mode arrangement in which it can not move the trigger plate upon retraction of the work contact element, and the button is linked to the actuator so as to move the actuator to the safety mode arrangement when depressed from either of the opposite ends.

12. A fastener driving apparatus as defined in claim 10 wherein the button has a passage extending fully through the button, the actuator is movable through the passage under the influence of the work contact element, and the actuator is fitted within the passage so as to be moveable with the button in the sideways directions.

13. A fastener driving apparatus as defined in claim 10 wherein the actuator is mounted on the work contact element so as to slide across the work contact element in the sideways directions under the influence of the button.

14. A fastener driving apparatus as defined in claim 10 wherein the trigger plate is movable with the trigger to a pulled position, the actuator is moveable with the work contact element to a retracted position, and the actuator is configured to move to the retracted position in the sequential mode arrangement without contacting the trigger plate if the trigger plate is in the pulled position.

15. A fastener driving apparatus comprising:

a nose configured to eject a fastener;

a work contact element configured to retract relative to the nose;

a valve stem;

a trigger;

a trigger plate mounted on the trigger to depress the valve stem upon moving to a pulled position; and an actuator that is moveable with the work contact element from an advanced position to a retracted position, and is thus moveable into engagement with the trigger plate for supporting the trigger plate to depress the valve stem in a bump mode arrangement and a sequential mode arrangement;

the actuator having a bump mode surface with a first path of movement into supporting engagement with the trigger plate when the actuator is in the bump mode arrangement, having a sequential mode surface with a second path of movement into supporting engagement with the trigger plate when the actuator is in the sequential mode arrangement, and being configured for the trigger plate to move out of the second path of movement upon moving to the pulled position when the actuator is in the advanced position.

16. A fastener driving apparatus as defined in claim 15 wherein the bump mode surface has a larger size for the trigger plate to remain in the first path of movement, and the sequential mode surface has a smaller size for the trigger plate to move out of the second path of movement.

17. A fastener driving apparatus as defined in claim 15 wherein the bump mode surface and the sequential mode surface are coplanar.

18. A fastener driving apparatus as defined in claim 15 wherein the actuator has a safety mode arrangement in which it does not move into supporting engagement with the trigger plate upon moving from the advanced position to the retracted position.

19. A fastener driving apparatus as defined in claim 18 wherein the actuator has a gap into which the trigger plate is receivable upon movement of the actuator from the advanced position to the retracted position in the safety mode arrangement.

* * * * *